US008311256B1

(12) United States Patent
Strauser

(10) Patent No.: US 8,311,256 B1
(45) Date of Patent: Nov. 13, 2012

(54) SYSTEM, METHOD AND APPARATUS FOR HOLDING A DEVICE AND CONTAINING A MICROPHONE

(76) Inventor: Jack Strauser, Pinellas Park, FL (US)

( * ) Notice: Subject to any disclaimer, the term of this patent is extended or adjusted under 35 U.S.C. 154(b) by 224 days.

(21) Appl. No.: 12/889,951

(22) Filed: Sep. 24, 2010

(51) Int. Cl.
*H04R 9/08* (2006.01)

(52) U.S. Cl. ..... 381/365; 381/366; 381/361

(58) Field of Classification Search ..... 381/361, 381/362, 363, 364, 365, 366, 368
See application file for complete search history.

(56) References Cited

U.S. PATENT DOCUMENTS 5,349,480 A * 9/1994 Takao ..... 381/119
2009/0292851 A1 11/2009 Mead et al.

FOREIGN PATENT DOCUMENTS

KR 10-2002-0017647 A 3/2002
KR 10-0884503 B1 2/2009
KR 10-2009-0116275 A 11/2009
WO 2004-029891 A1 4/2004

* cited by examiner

*Primary Examiner* — Brian Ensey

(74) *Attorney, Agent, or Firm* — Larson & Larson, P.A.; Frank Liebenow; Justin Miller

(57) ABSTRACT

An application for a music system includes an enclosure and at least one cavity formed in the enclosure. The cavity(s) have side slots sized to interface with a hand of a person and have an opening towards the top. The opening towards the top of each of the cavities is sized to accept and hold a microphone. The cavities are used to carry the system and alternately hold one or more microphones.

11 Claims, 8 Drawing Sheets

SYSTEM, METHOD AND APPARATUS FOR HOLDING A DEVICE AND CONTAINING A MICROPHONE

CROSS-REFERENCE TO RELATED APPLICATION

This application is related to a co-pending application, filed even date, Ser. No. 12/889,941, titled, "SYSTEM, METHOD AND APPARATUS FOR DIRECTIONAL SPEAKERS". This application is also related to a co-pending application, filed even date, Ser. No. 12/889,983, titled, "SYSTEM, METHOD AND APPARATUS FOR SUPPORTING AND PROVIDING POWER TO A MUSIC PLAYER."

FIELD

This invention relates to the field of music devices and more particularly to a system for a combination device handle and microphone holder.

BACKGROUND

Many existing musical devices such as portable stereo systems and portable karaoke systems have handles to facilitate carrying of the device from place to place. Some prior art handles are simple cavities in the device enclosure that are big enough for a user's hand. Some prior art handles are attached to the devices similar to a screen door handle, allowing the user to put their fingers under the handle when carrying the device. Still other handles are attached to the device and swivel from a flat, closed position, to a raised, open position in which the user is able to grab the exposed portion for carrying.

Additionally, many such devices also provide microphones for recording voice and/or, in the case of karaoke devices, for performing. Some of these devices with microphones do not have a place or clasp for holding and/or storing the microphone, so when transporting, storage or when not in use, there is no designated location for the microphone and, the microphone often finds itself on a table surface, in a drawer or possibly lost. As a partial solution to this, some such devices have clasps or hooks for holding the microphones. The microphone(s) slip into the holder and are easy to find the next time the device is used.

In the prior art, two or more separate appendages and/or indentations were required, some for holding the microphone (s) and others for use as handles. This leads to increased costs for materials, molding operations, etc. this also leads to decreases in reliability being that there are more things that can break on the enclosure.

What is needed is a dual-purpose system that provides both handle functionality and holds one or more microphones.

SUMMARY

In one embodiment, a music system is disclosed including an enclosure and at least one cavity formed in the enclosure. The cavity(s) have side slots sized to interface with a hand of a person and have an opening towards the top. The opening towards the top of each of the cavities is sized to accept and hold a microphone. The cavities are used to carry the system and alternately hold one or more microphones.

In another embodiment, a method of using a music system is disclosed. The music system has an enclosure and at least one cavity in the enclosure that forms both a handle and a microphone holder. The cavity has side slots sized to accept a hand of a person and has an opening towards the top of the cavity. The opening towards the top of the cavity is sized to accept and hold a microphone. The method includes storing microphones in each of the opening towards the top of the cavity then, later, removing at least one of the microphones and inserting a hand into at least one of the cavities for carrying the music system by holding the music system through the at least one cavity.

In another embodiment, a music system is disclosed including an enclosure and an integrated handle system. The integrated handle system is for carrying the music system and when the music system is not being carried, the integrated handle system provides a place for holding one or more microphones.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
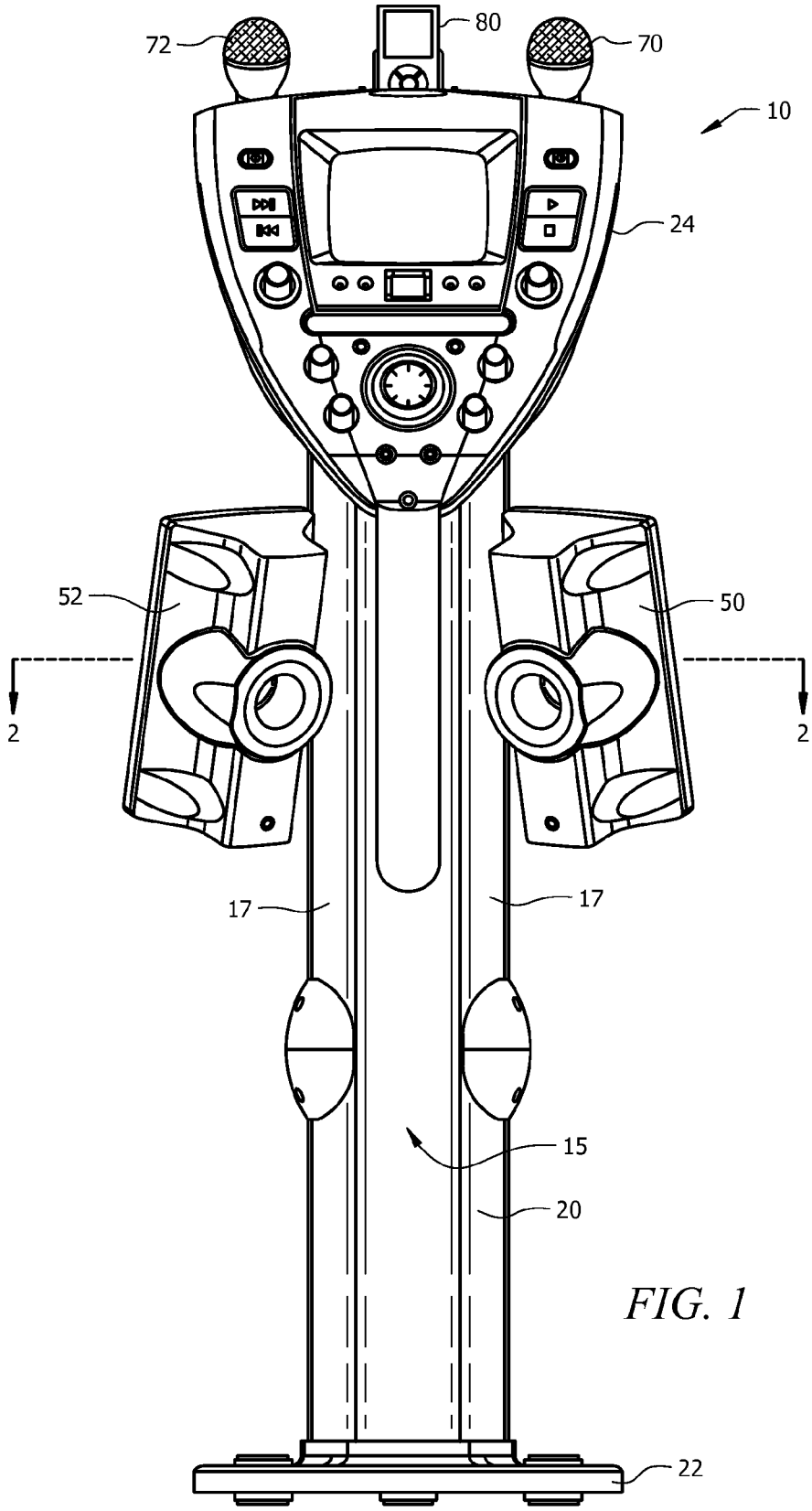
FIG. 1 illustrates a front perspective view of a directional speaker system.

Reference will now be made in detail to the presently preferred embodiments of the invention, examples of which are illustrated in the accompanying drawings. Throughout the following detailed description, the same reference numerals refer to the same elements in all figures.

Figure 2A:
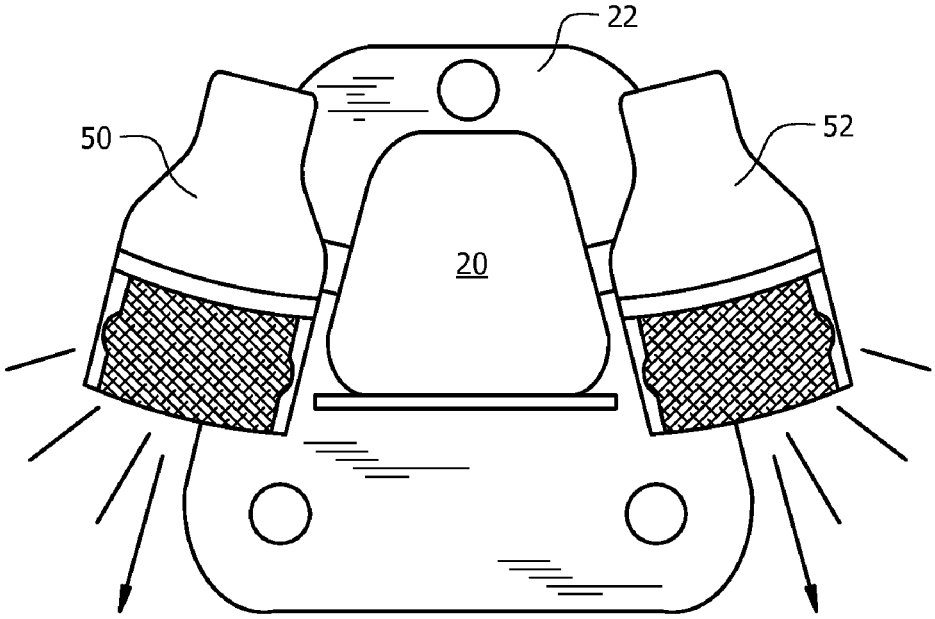
FIG. 2A illustrates a top view of the directional speaker system with speakers facing an audience.
Figure 2B:
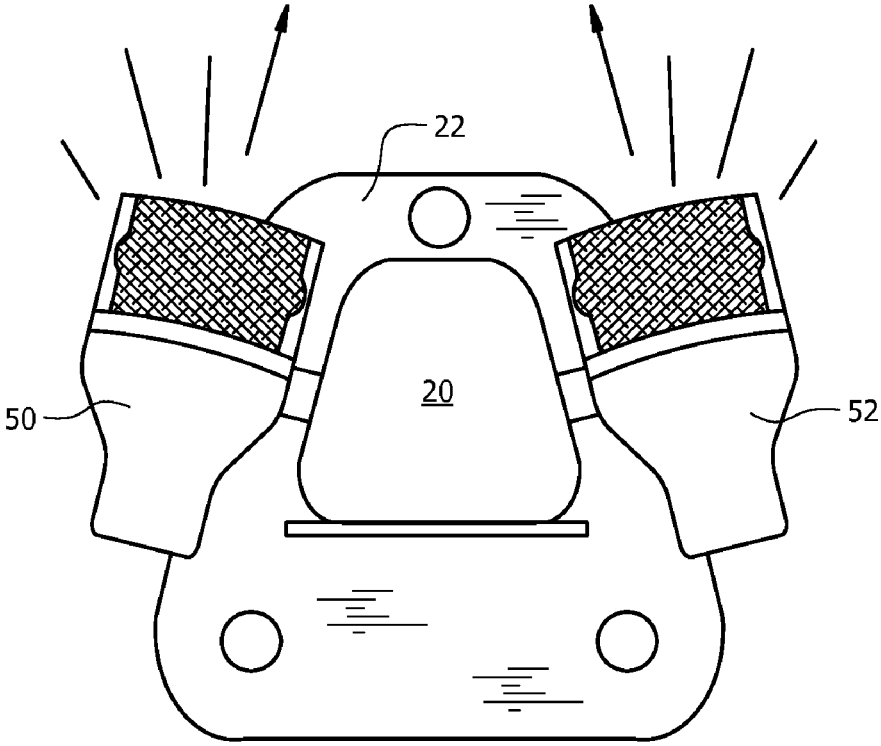
FIG. 2B illustrates a top view of the directional speaker system with speakers facing a performer.

Referring to FIGS. 1, 2A, 2B, perspective view of a directional speaker system is shown. For explanation purposes, a pedestal karaoke system 10 is used as an exemplary device. The elements of the disclosed invention are applicable to other portable and/or stationary devices and are not limited to a karaoke system.

Figure 7:
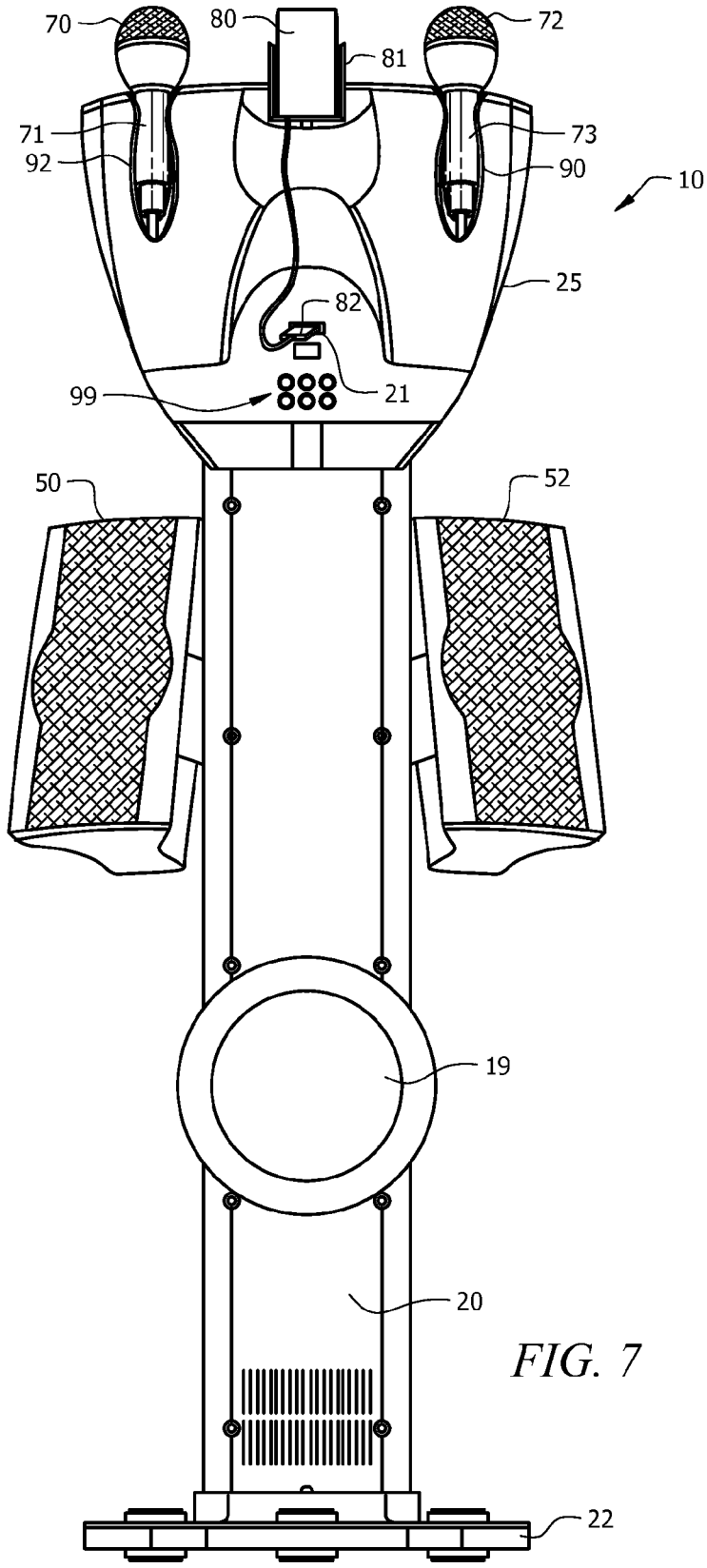
FIG. 7 illustrates a rear perspective view of the system.
Figure 8:
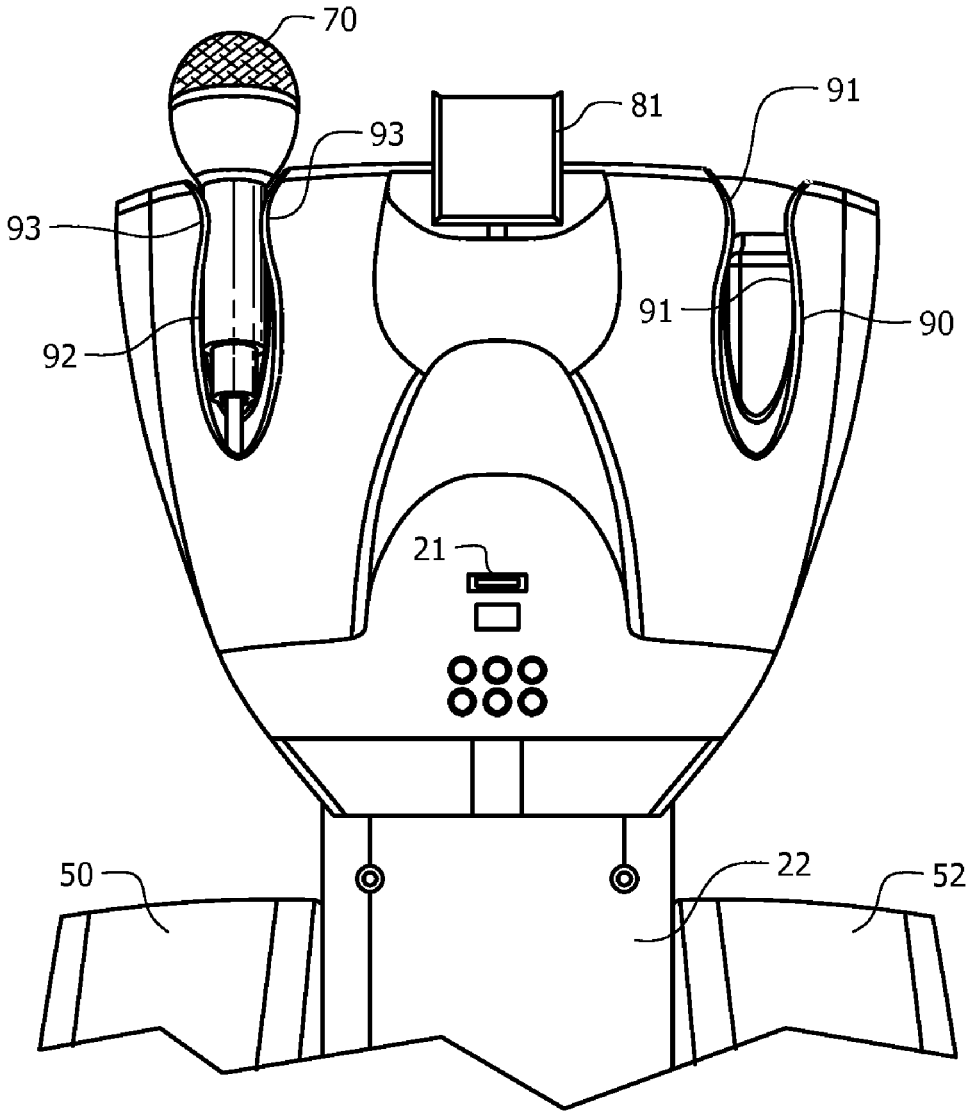
FIG. 8 illustrates a rear perspective view of the system showing handle/microphone storage in detail.
Figure 9:
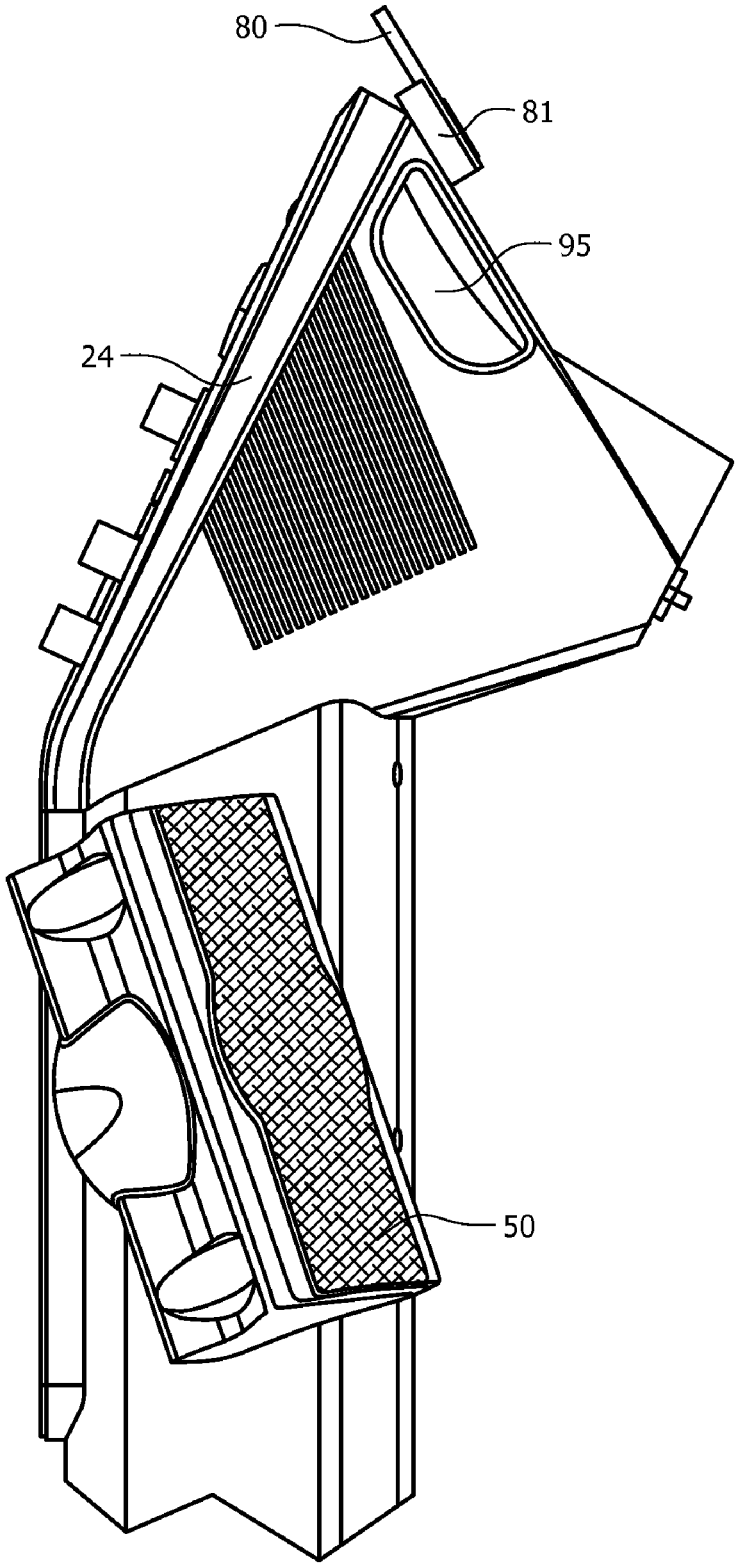
FIG. 9 illustrates a side perspective view of the system.

The exemplary system 10 has a system console 24 supported by a pedestal 20. The system console 24 typically has controls (e.g. volume, play, stop, etc), displays and indicators. In this exemplary system 10, music or karaoke content comes from a music player 80 that is inserted into a cradle 81 (see FIG. 8) and connected to audio inputs 99 of the exemplary system 10. In this example, there are two microphones 70/72 in dual-purpose handle/microphone holders 90/92 (see FIG. 7).

The system is supported by a base 22, preferably wider than the pedestal 20 to reduce the probability of tipping.

The pedestal 20 has side walls 17. Preferably, the side walls 17 of the pedestal 20 are not parallel and purposely angle towards each other getting closer towards the front of the pedestal 15, where the user typically stands. Two speakers 50/52 are rotatably mounted to the side walls 17 of the pedestal 20. The speakers 50/52 are rotated to face away from the user (performer) as shown in FIG. 2A when the user (performer) is using the system 10 with other people (e.g. an audience). Since the speakers 50/52 are angled outwardly due to the angle of the side walls 17, sound from the speakers 50/52 diverge and produce sound that is better distributed to multiple listeners (e.g. the audience). The speakers 50/52 are rotated to face the user (performer) as shown in FIG. 2 when the user (performer) is not concerned with other people hearing the performance. Since the speakers 50/52 are angled inwardly due to the angle of the side walls 17, sound from the speakers 50/52 converge to a point near the user (performer) and produce sound that is concentrated for the enjoyment of the user (performer).

Note that other mechanisms are anticipated that provide the same feature in which the speakers are directed outwardly (sound is aimed away from straight ahead) when facing away from the performer and in which the speakers are directed inwardly (sound is aimed to a focal point near the performer) when facing the performer. For example, in some embodiments, the sides of the pedestal 20 are parallel, but the rotating posts that support the speakers 50/52 are at an angle with respect to the side walls of the pedestal 20. In some embodiments, more than two rotatable speakers 50/52 are anticipated (not shown).

Figure 3:
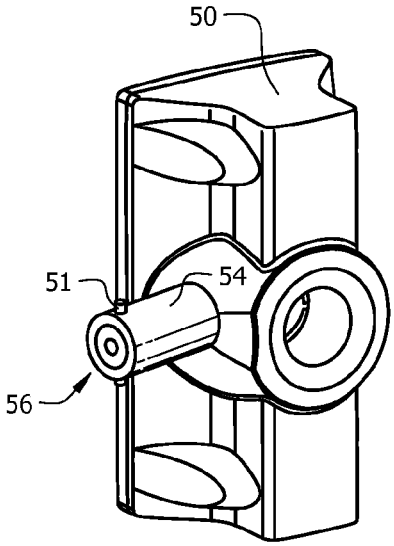
FIG. 3 illustrates a perspective view of a keyed rotating attachment system.
Figure 4:
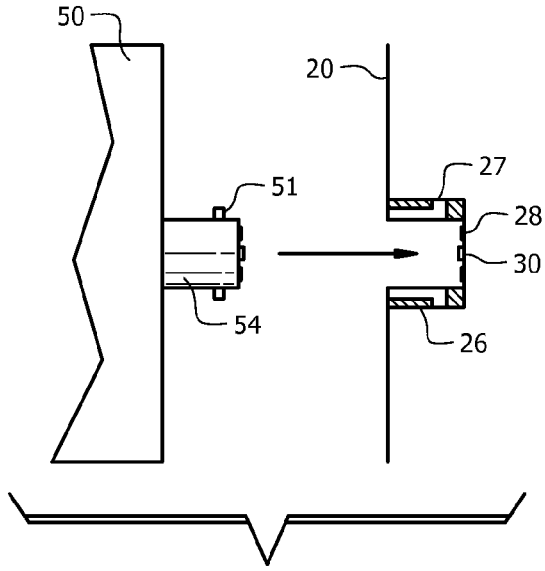
FIG. 4 illustrates a cutaway view of a keyed rotating attachment system.
Figure 5:
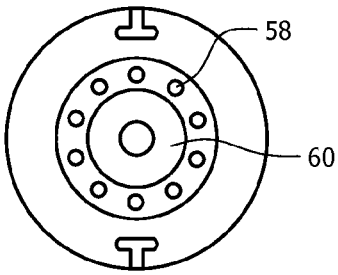
FIG. 5 illustrates a perspective view of an electrical interface of the rotating attachment system.
Figure 6:
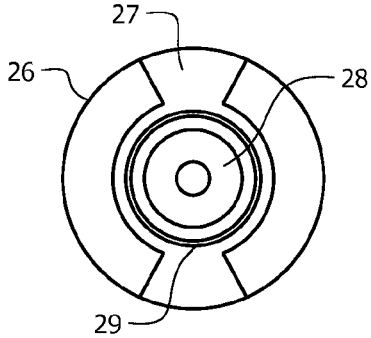
FIG. 6 illustrates a perspective view of a mating electrical interface of the rotating attachment system.

Referring to FIGS. 3-6, views of a keyed rotating attachment system is shown. In FIG. 3, only one speaker 50 is shown (more than one speaker is anticipated). The speaker 50 has a rotating support post 54 that has one or more key posts 51, In some embodiments, a speaker electrical interface 56 is provided to connect the speaker 50/52 to the audio outputs of the system 10 (details shown in FIGS. 5 and 6). The key posts 51 slide into slots 27 of a cavity 26 of the system 10 when the speaker 50/52 is, for example, horizontal (90 degrees rotated from the position shown in FIG. 1). Once inserted, the speakers 50/52 are rotated toward the audience (diverging) or toward the performer (converging), thereby locking the key posts 51 into the slots 27. Any other way of a rotatable connection is anticipated, permanent or removable.

In some embodiments, electrical connections are provided to connect the speakers 50/52 to the audio outputs of the system 10. There are many ways known to electrically connect a rotating device (e.g. a wind generator is rotatably mounted to a tower and electricity passes through the rotatable interface from the generator to the electrical connections at the ground). The example shown has two sets of connectors 58/60 on the speaker support post 54 that connect to contacts 28 and 29 in the cavity 26.

Alternately, in some embodiments, the speakers 50/52 are electrically connected to the system 10 by wires (not shown) instead of through electrical connections associated with the rotating connection.

Referring to FIGS. 7-10, perspective views of the system showing the combined handle/microphone feature will be described. In some embodiments, a music player 80 provides content (e.g. music, karaoke content, video, etc). In such, the music player 80 sits in a cradle 81. For convenience, a power port (e.g. USB port) 21 is provided, into which the power cable plug 82 (e.g. USB plug) is connected to provide power to the music player 80. Although not shown, audio from the music player is connected to the audio input jacks 99 of the system 10.

In some embodiments, the system 10 includes a base speaker 19 (e.g. a sub-woofer), preferably mounted in the pedestal 20.

Figure 10:
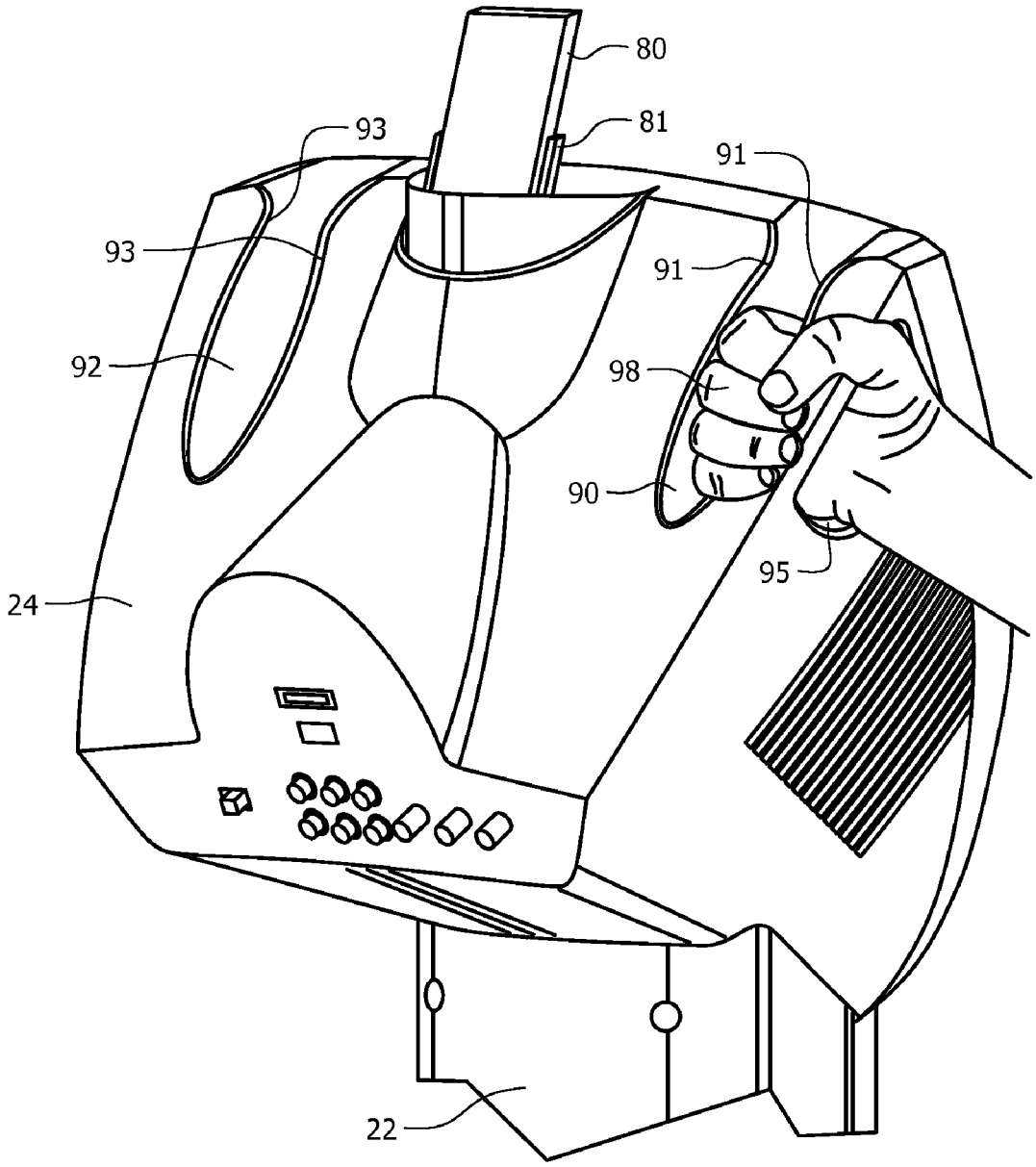
FIG. 10 illustrates a rear perspective view of the system showing handle/microphone in use as a handle.

Handles 71/73 of the microphones 70/72 are inserted into microphone holders 90/92 that double as handles 90/92. A convex surface 91/93 of the microphone holders 90/92 that double as handles 90/92 keeps the microphone handles 71/73 from falling out while providing enough of an opening for a persons fingers 98 (see FIG. 10) when using the microphone holders 90/92 that double as handles 90/92 as handles as shown in FIG. 10. The sides of the system console 24 has a handle opening 95 through which the user's fingers 98 fit, wrapping through and out of the microphone holders 90/92 that double as handles 90/92. The shape of the handle 90/91/92/93/95 is preferably, though not required, shaped to comfortably interface with a typical hand and fingers 98 of a person who carries the system 10.

Figure 11:
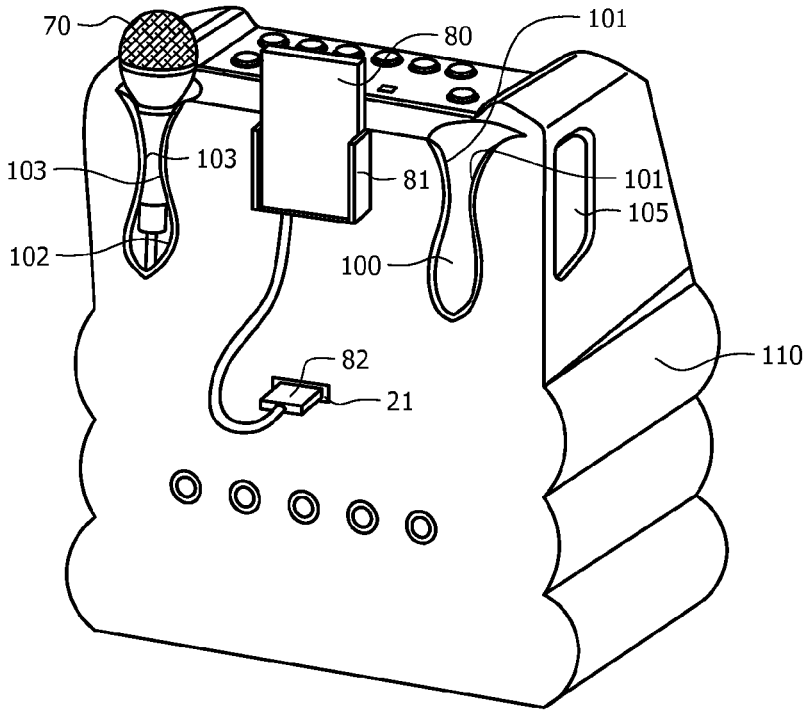
FIG. 11 illustrates a rear perspective view of another exemplary system showing handle/microphone storage in detail.
Figure 12:
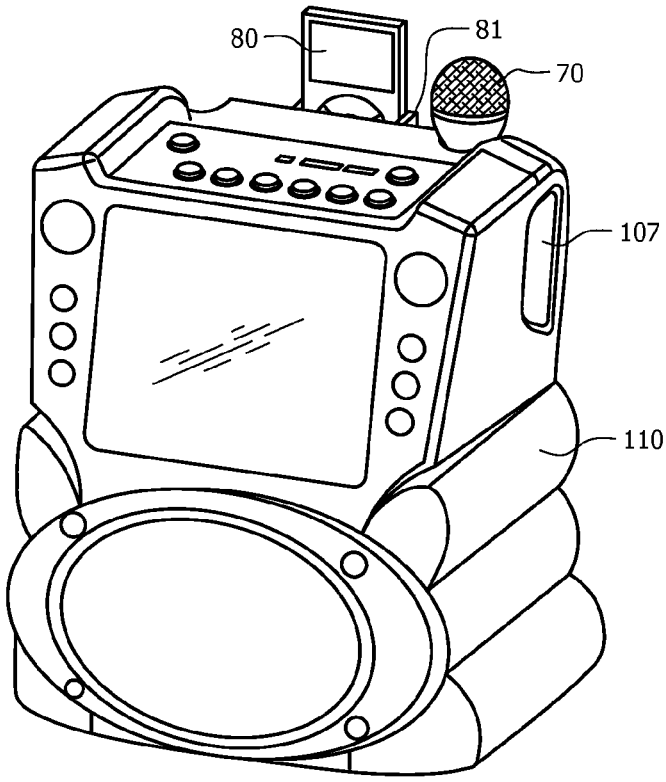
FIG. 12 illustrates a front perspective view of the second exemplary system showing a microphone in storage.

Referring to FIGS. 11 and 12, perspective view of another exemplary system 110 showing handle/microphone storage 100/102 in detail will be described. For storage, the handles 71/73 of the microphones 70/72 (only one microphone 70 is shown) are inserted into microphone holders 100/102 that double as handles 100/102. A convex surface 101/103 of the microphone holders 100/102 that double as handles 100/102 keeps the microphone handles 71/73 from falling out while providing enough of an opening for a persons fingers when using the microphone holders 100/102 that double as handles 100/102 as handles as shown in FIG. 11. The sides of the exemplary system 110 has a handle opening 105/107 through which the user's fingers 98 fit, wrapping through and out of the microphone holders 100/102 that double as handles 100/102. The shape of the handle 100/101/102/103/105/107 is preferably, though not required, shaped to comfortably interface with a typical hand and fingers 98 of a person who carries the system 110.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A music system, the music system comprising:

an enclosure; and at least one cavity formed in the enclosure, the cavity having side slots sized to interface with a hand of a person and the cavity having an opening towards the top, the opening towards the top sized to accept and hold a microphone;

wherein each of the cavities are used to carry the system and alternately to hold a microphone.

2. The music system of claim 1, wherein there are exactly two of the cavities.

3. The music system of claim 1, wherein the cavities pass from a side surface of the enclosure to a back surface of the enclosure.

4. The music system of claim 3, wherein an opening of the cavities on the back surface of the enclosure has a concave edge, the concave edge holding the microphones.

5. A method of using a music system, the music system comprising:

an enclosure; and at least one cavity in the enclosure forming both a handle and a microphone holder, the cavity having side slots sized to accept a hand of a person and the cavity having an opening towards the top of the cavity, the opening towards the top of the cavity sized to accept and hold a microphone;

the method comprising:

storing microphones in each of the opening towards the top of the cavity;

removing at least one of the microphones; and inserting a hand into at least one of the cavities and carrying the music system by holding the music system through the at least one cavity.

6. The method of claim 5, wherein there are exactly two of the cavities.

7. The method of claim 5, wherein the cavities pass from a side surface of the enclosure to a back surface of the enclosure.

8. The method of claim 7, wherein an opening of the cavities on the back surface of the enclosure has a concave edge, the concave edge holding the microphones while allowing fingers to pass and grip the music system.

9. A music system, the music system comprising:

an enclosure; and means for carrying the music system, the means for carrying integrated into the music system and the means for carrying providing means for holding a microphone, the means for carrying the music system consists of two cavities;

wherein the mean for carrying is used to carry the system and alternately to hold microphones.

10. The music system of claim 9, wherein the cavities pass from a side surface of the enclosure to a back surface of the enclosure.

11. The music system of claim 10, wherein an opening of the cavities on the back surface of the enclosure has a concave edge, the concave edge holding the microphones.

* * * * *